US008826842B2

(12) United States Patent
Hinrichs

(10) Patent No.: US 8,826,842 B2
(45) Date of Patent: Sep. 9, 2014

(54) METHOD AND SYSTEM OF A MARINE FAIRING

(75) Inventor: Richard Hinrichs, Villefranche sur Mer (FR)

(73) Assignee: PGS Geophysical AS, Oslo (NO)

( * ) Notice: Subject to any disclaimer, the term of this patent is extended or adjusted under 35 U.S.C. 154(b) by 205 days.

(21) Appl. No.: 13/403,007

(22) Filed: Feb. 23, 2012

(65) Prior Publication Data

US 2013/0220202 A1 Aug. 29, 2013

(51) Int. Cl.
*F15D 1/10* (2006.01)

(52) U.S. Cl.
USPC ..... 114/243

(58) Field of Classification Search
USPC ..... 114/243
IPC ..... B63B 21/663
See application file for complete search history.

(56) References Cited

U.S. PATENT DOCUMENTS

| | | | | |
|---|---|---|---|---|
| 3,440,993 | A * | 4/1969 | Taylor, Jr. et al. | 114/243 |
| 3,443,020 | A * | 5/1969 | Loshigian | 174/101.5 |
| 3,859,949 | A * | 1/1975 | Toussaint et al. | 114/243 |
| 4,033,279 | A * | 7/1977 | Stiles | 114/243 |
| 4,075,967 | A | 2/1978 | Silvey | |
| 4,365,574 | A | 12/1982 | Norminton | |
| 4,542,708 | A | 9/1985 | Holcombe et al. | |
| 5,410,979 | A | 5/1995 | Allen et al. | |
| 5,456,199 | A * | 10/1995 | Kernkamp | 114/111 |
| 5,722,340 | A | 3/1998 | Sweetman | |
| 6,257,161 | B1 | 7/2001 | Lindeman et al. | |
| 6,755,595 | B2 * | 6/2004 | Oram | 405/216 |
| 8,096,253 | B1 * | 1/2012 | Ruffa | 114/243 |
| 2008/0236469 | A1 * | 10/2008 | Masters et al. | 114/243 |

* cited by examiner

*Primary Examiner* — Stephen Avila

(57) ABSTRACT

A marine fairing. At least some of the illustrative embodiments are methods of installing a fairing on a line. In installing may include: wrapping a flap portion of the fairing at least partially around the line; and coupling an appendage defined by the fairing into a hollow defined by the fairing such that a distal portion of flap abuts a body portion of the fairing.

22 Claims, 9 Drawing Sheets

METHOD AND SYSTEM OF A MARINE FAIRING

BACKGROUND

Marine surveys may be used to determine the location and/or state of a hydrocarbon bearing earth formation residing below a body of water. Marine surveys using towed survey streamers may use as many as ten or more survey streamers spaced horizontally, with the survey streamers towed behind a tow vessel and in proximity to the hydrocarbon bearing earth formation. In the related art, each survey streamer has an associated lead-in cable comprising electrical and/or optical conductors, the lead-in cables coupled to the tow vessel. While the lead-in cable for any particular survey streamer may carry little, if any, towing force, the lead-in cables themselves contribute to drag, and are subject to "strumming" caused by vortex shedding as the cable moves through the water.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection or through an indirect connection via other devices and connections.

"Cable" shall mean a flexible, load carrying member that also comprises electrical conductors and/or optical conductors for carrying electrical power and/or signals between components.

"Rope" shall mean a flexible, load carrying member that does not include electrical and/or optical conductors. Such a rope may be made from fiber, steel, other high strength material, chain, or combinations of such materials.

"Line" shall mean either a rope or a cable.

DETAILED DESCRIPTION

The following discussion is directed to various embodiments of the invention. Although one or more of these embodiments may be preferred, the embodiments disclosed should not be interpreted, or otherwise used, as limiting the scope of the disclosure or the claims. In addition, one skilled in the art will understand that the following description has broad application, and the discussion of any embodiment is meant only to be exemplary of that embodiment, and not intended to intimate that the scope of the disclosure or the claims is limited to that embodiment.

The various embodiments are directed to fairings for lines used in marine applications, such as marine surveys. In a particular embodiment, the fairings are used for lead-in cables, but many lines used in a marine survey or in other applications may benefit from use of fairings. The specification first turns to an illustrative marine survey system to orient the reader, and then to example embodiments of the fairings and example methods of coupling the fairings to the lines.

Figure 1:
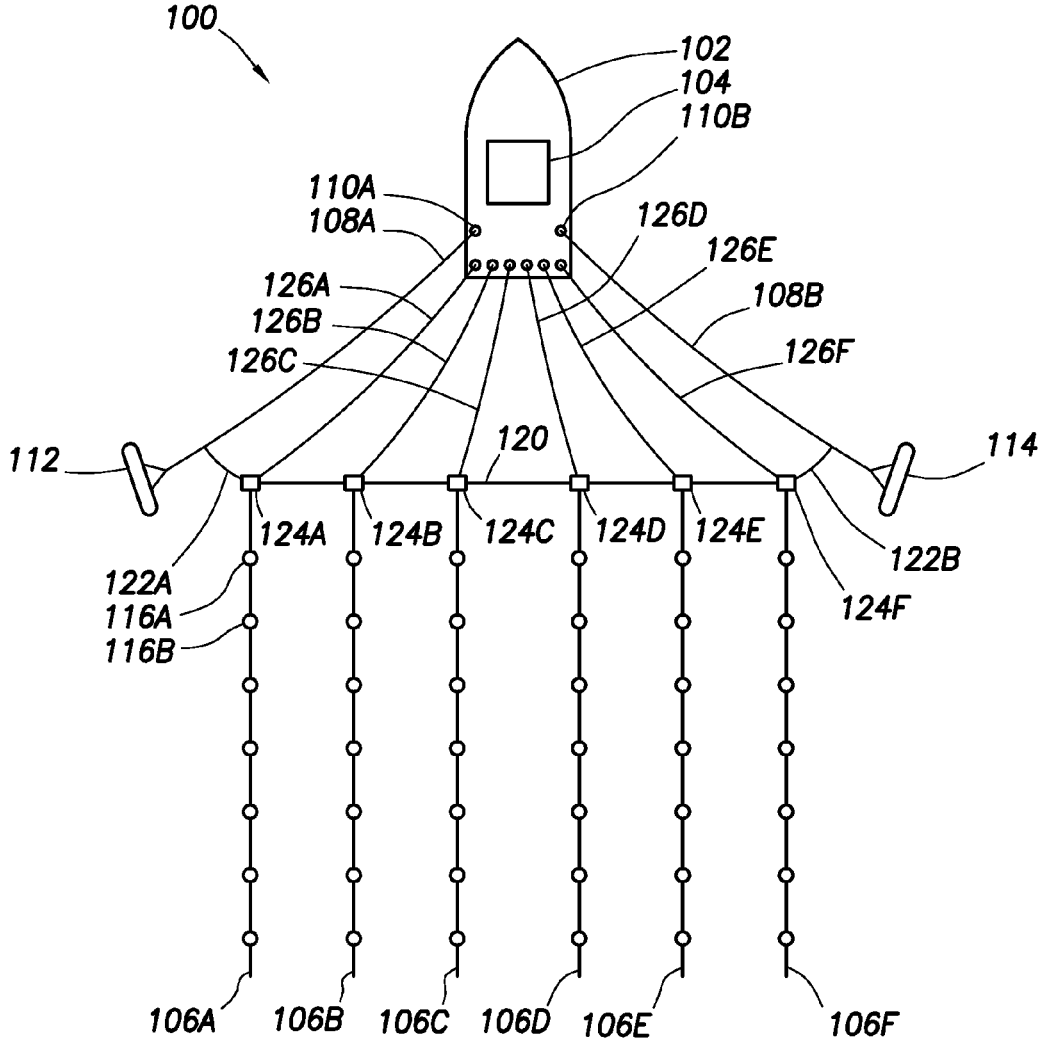
FIG. 1 shows an overhead view of a marine survey system in accordance with at least some embodiments.

FIG. 1 shows an overhead view of a marine survey system 100 in accordance with at least some embodiments. In particular, FIG. 1 shows a survey vessel 102 having onboard equipment 104, such as navigation, energy source control, and data recording equipment. Survey vessel 102 is configured to tow one or more streamers 106A-F through the water. While FIG. 1 illustratively shows six streamers 106, any number of streamers 106 may be used. The discussion continues with respect to streamers 106 being sensor streamers, but streamers 106 are illustrative of any towed geophysical survey cable, such as transmitter cables and source cables.

The sensor streamers 106 are coupled to towing equipment that maintains the streamers 106 at selected depth and lateral positions with respect to each other and with respect to the survey vessel 102. The towing equipment may comprise two paravane tow lines 108A and 108B each coupled to the vessel 102 by way of winches 110A and 110B, respectively. The winches enable changing the deployed length of each paravane tow line 108. The second end of paravane tow line 108A is coupled to a paravane 112, and the second end of paravane tow line 108B is coupled to paravane 114. In each case, the tow lines 108A and 108B couple to their respective paravanes through respective sets of lines called a "bridle". The paravanes 112 and 114 are each configured to provide a lateral force component to the various elements of the survey system when the paravanes are towed in the water. The combined lateral forces of the paravanes 112 and 114 separate the paravanes from each other until the paravanes put one or more spreader lines 120, coupled between the paravanes 112 and 114, into tension. The paravanes 112 and 114 either couple directly to the spreader line 120, or as illustrated couple to the spreader line by way of spur lines 122A and 122B.

The sensor streamers 106 are each coupled, at the ends nearest the vessel 102 (i.e., the proximal ends) to a respective lead-in cable termination 124A-F. The lead-in cable terminations 124 are coupled to or are associated with the spreader lines 120 so as to control the lateral positions of the streamers 106 with respect to each other and with respect to the vessel 102. Electrical and/or optical connections between the appropriate components in the recording system 104 and the sensors (e.g., 116A, 116B) in the streamers 106 may be made using lead-in cables 126A-F. Much like the tow lines 108 associated with respective winches 110, each of the lead-in cables 126 may be deployed by a respective winch or similar spooling device such that the deployed length of each lead-in cable 126 can be changed.

Figure 2:
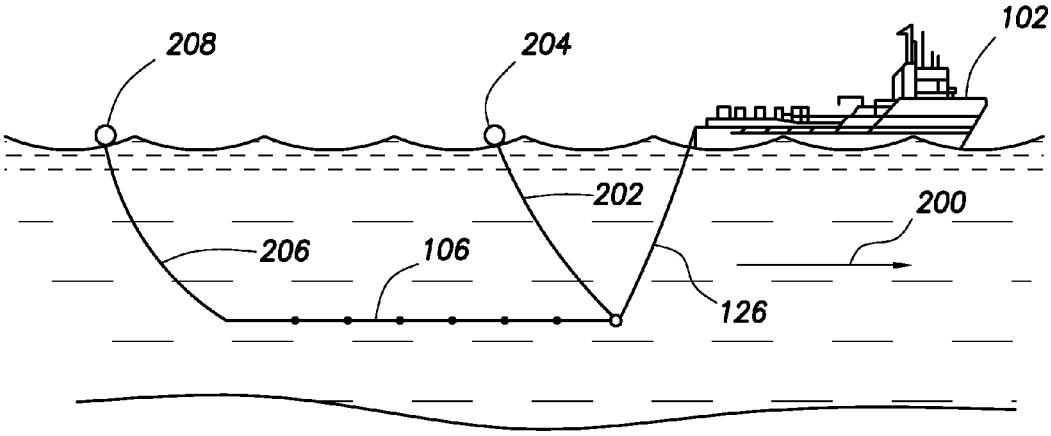
FIG. 2 shows a side elevation view of a marine survey in accordance with at least some embodiments.

FIG. 2 shows a side elevation view of the main survey system 100. In the view of FIG. 2, only a single lead-in cable 126 and sensor streamer 106 are shown. However, FIG. 2 further shows additional equipment in the form of rope 202 coupled to lead buoy 204, as well as a rope 206 coupled to tail buoy 208. The tow vessel 102 moves along in a direction of travel 200 towing the various lines. The sensor streamer 106 tends to orient itself parallel to the direction of travel, and thus presents a relatively small amount of drag. The other lines, however, such as the lead-in cable 126, rope 202, and rope 206 are oriented in the water in such a way as to present significantly more surface area to the direction of travel, and thus more drag. In most cases, the illustrative lines 126, 202, and 206 have circular cross section, which from a hydrodynamic standpoint is less than optimal. Moreover, each of the illustrative lines 126, 202, and 206 are subject to "strumming"—vibrating back and forth (in the view of FIG. 2, in and out of the plane of the page) based on vortex shedding around the lines. Other lines present similar difficulties, such as the spreader cable and paravane tow lines.

In order to at least partially reduce the drag, and/or to reduce vortex shedding, some or all of the illustrative lines 126, 202, and 206 may have coupled thereon fairings, which fairings change the shape presented to the direction of travel to a more favorable hydrodynamic shape. The balance of the specification discusses fairings with respect to the lead-in cables 126, but it will be understood that any line in the illustrative marine survey system 100 or other system that is towed through the water with the line's central axis non-parallel to the direction of travel 200 may benefit from the use of fairings.

Figure 3:
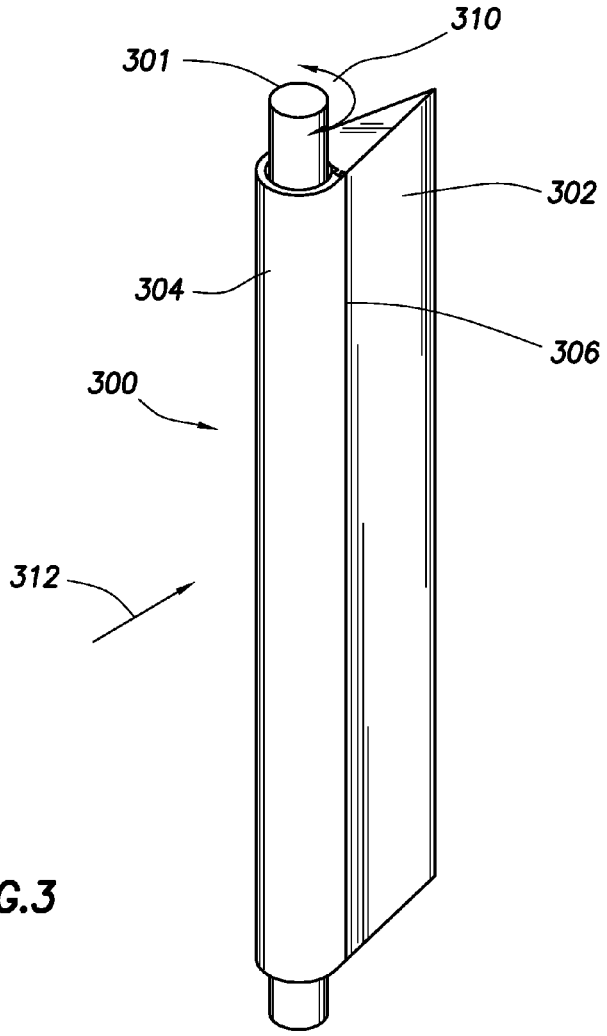
FIG. 3 shows a perspective view of a fairing and associated line in accordance with at least some embodiments.

FIG. 3 shows a perspective view of a fairing 300 coupled to a line 301. In particular, the fairing 300 comprises a main body portion 302 and a flap portion 304. The flap portion 304 is wrapped around to encompass the line 301, and the flap portion 304 couples to the main body portion 302 in the configuration shown in FIG. 3. A seam 306 representing the distal end of the flap portion 304 folded back upon the main body portion 302 is visible in FIG. 3, and various illustrative mechanisms for connecting the flap portion 304 to the main body portion 302 are discussed more below. In accordance with at least some embodiments, the flap portion 304 is loosely coupled around the line 301 such that the fairing 300 may "weathervane" around the line 301, the "weathervane" action illustrated by double-headed arrow 310. Finally with respect to FIG. 3, when the fairing 300 is coupled to the line 301 the outer surface of the fairing 300 defines a more favorable hydrodynamic shape relative to water flow across the fairing, the relative water flow illustrated by arrow 312. As illustrated, the cross-sectional shape of the outer surface of the fairing 300 is that of a symmetric airfoil; however, other shapes are possible, and are discussed more below. The specification now turns to a more detailed discussed of the various components of the fairing 300.

Figure 4:
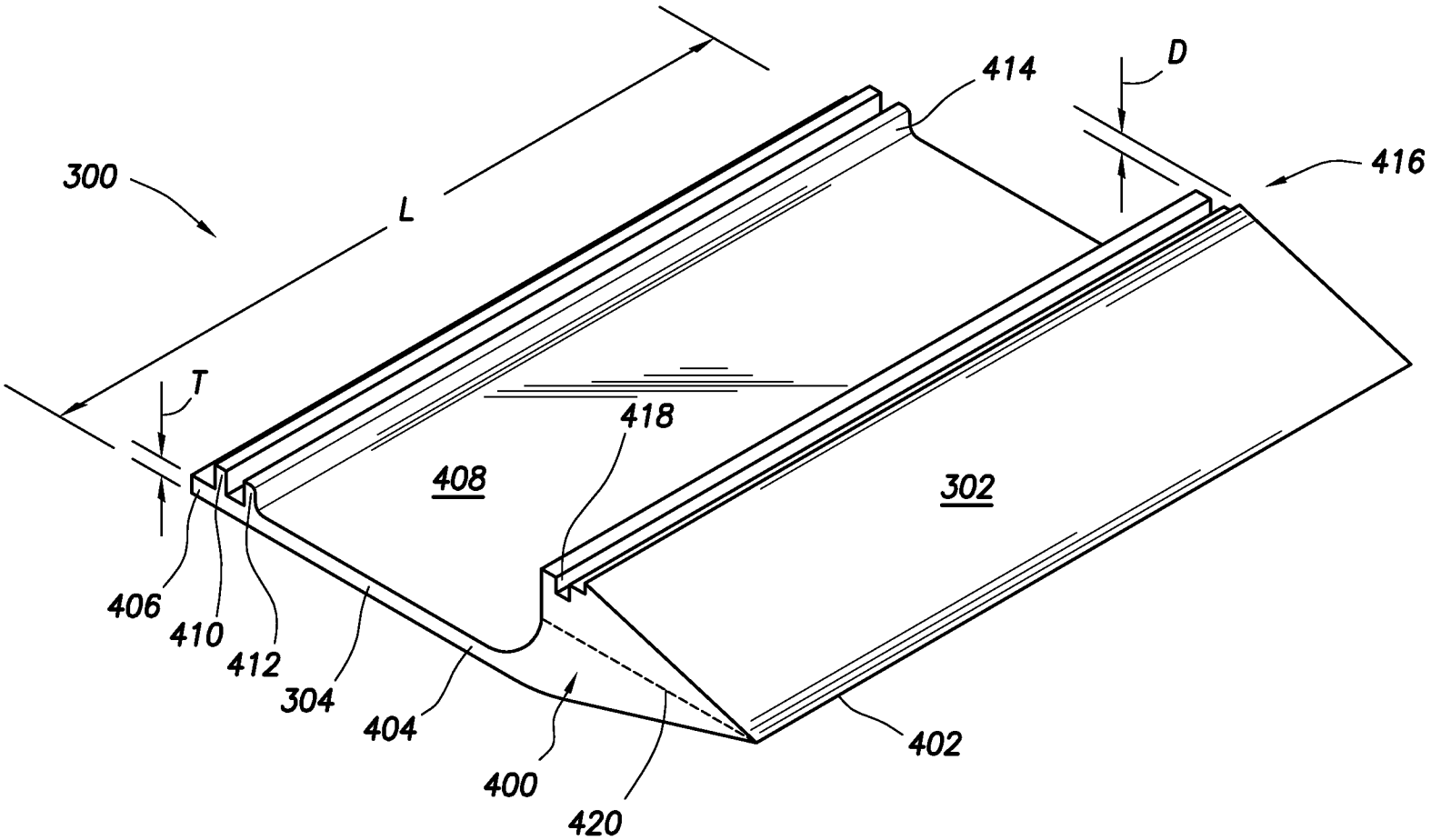
FIG. 4 shows a perspective view of a fairing, in an open configuration, in accordance with at least some embodiments.

FIG. 4 shows a perspective view of an illustrative fairing 300 in the open or non-coupled configuration. In particular, the fairing 300 defines a long dimension L. The long dimension L, when the fairing 300 is coupled to a line, is parallel to the central axis of the line. Main body portion 302 defines a thicker portion 400, and the main body portion 302 thins toward the distal end 402. While the thicker portion 400 is show as solid, in other embodiment the thicker portion may define a hollow interior of any suitable shape. The flap portion 304 couples to the main body portion 302 at the proximal end 404, and the flap portion 304 also defines a distal end 406. Flap portion 304 further defines an inner surface 408 (i.e., the surface that abuts the line when the flap portion 304 is folded over to couple to the main body portion 302). In accordance with various embodiments the flap portion 304 also comprises an appendage 410 that protrudes from the inner surface 408 on the distal end 406 of the flap portion 304. The appendage 410 as illustrated has a rectangular cross-section, but other cross-sectional shapes are possible and are discussed more below. In some embodiments a shoulder member 412 protrudes from the inner surface 408 on the distal end of the flap portion 304. Illustrative shoulder member 412, when present, may define a semi-circular region 414 that abuts the line when the flap portion 304 is wrapped around the line.

The main body portion 302 further comprises an offset region 416 within which a hollow 418 is located. In accordance with at least some embodiments, the hollow 418 defines a cross-sectional shape that is a negative image of the cross-sectional shape of the appendage 410 on the distal end 406 of the flap member 304. Thus, in the illustrative embodiments of FIG. 4, the hollow takes the form of a rectangular groove, but again other cross-sectional shapes for the appendage 410 and groove 418 are discussed more below. In some embodiments the depth D of the offset region 416 is about the same as the thickness T of the distal end 406 of the flap member 304; however, in other cases the offset region 416 may be omitted, with the hollow 418 residing directly in the outer surface of the main body member 302.

In accordance with at least some embodiments, the diameter of a lead-in cable around which the flap portion 304 is wrapped may be on the order of 38 to 40 milli-meters, but use of a fairing with larger and smaller diameter lead-in cables, as well as other lines, is also contemplated. Moreover, in at least some embodiments the long dimension L of the fairing 300 may be on the order of 2.5 meters, but longer and shorter fairings may also be used. Further, in at least some embodiments the length of the main body portion 302, as measured along the chord (dashed line 420 in FIG. 4—from the portion that abuts the lead-in cable to the distal end 402), may be on the order 15 to 20 centimeters, but again longer and short lengths are also contemplated.

In a particular embodiment, the material from which the fairing 300 is constructed is an extruded thermoplastic with resilient properties, thus offering corrosion resistance in fresh and salt water use, but also enabling the fairings 300 to be rolled onto spools or reels with their associated lead-in cables without the fairings 300 being removed. Nonlimiting examples of extrudable thermoplastic resins suitable for use in constructing fairings include homopolymers and copolymers of alpha-olefins such as ethylene homopolymers, ethylene copolymers, propylene homopolymers and propylene copolymers; polymers of ethylenically unsaturated monomers such as polymers of acrylic and methacrylic esters; polyurethane; polysulfone; polyphenyl sulfide; and combinations thereof. In some cases, polymers suitable for use in constructing the fairings 300 may contain additives to improve one or more properties of the polymer. Examples of additives include, but are not limited to, antistatic agents, colorants, stabilizers, nucleators, surface modifiers, pigments, slip agents, antiblocks, tackafiers, polymer processing aids, and combinations thereof. Such additives may be used singularly or in combination and may be included in the polymer before, during, or after preparation of the polymer as described herein. Such additives may be added via any suitable technique, for example during an extrusion step or subsequent processing into an end use article.

Figure 5A:
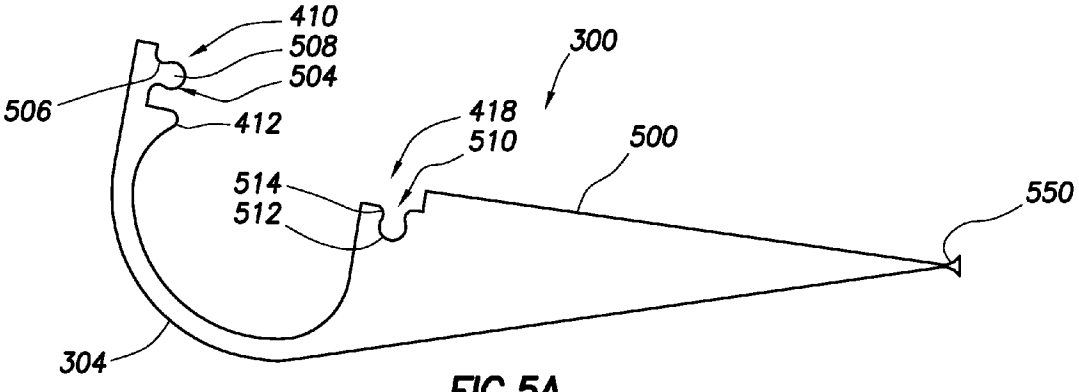
FIG. 5A shows a side elevation view of fairing in a partially open configuration, with a bulb-like appendage, and in accordance with at least some embodiments.

The specification now turns to various example configurations of the appendage 410 and corresponding hollow 418. FIG. 5A shows a side elevation view of fairing 300 with the flap portion 304 partially open. However, FIG. 5 also shows an alternative appendage 410 and hollow 418 configurations. In particular, the appendage 410 of FIG. 5 takes the form of a rail 504 comprising a proximal portion 506 and a distal portion 508. The proximal portion 506 has a thinner cross-sectional shape, while the distal portion 508 has a thicker cross-sectional shape. In the illustration of FIG. 5A, the thicker cross-sectional shape is circular.

Likewise, the hollow 418 in these embodiments defines an extended groove having a cross-sectional shape that is a negative image of the rail 504. In particular, groove 510 has a deeper portion 512 that is larger than a shallow portion 514. Moreover, the deeper portion 512 has a cross-sectional shape that matches that of portion 508.

Figure 5B:
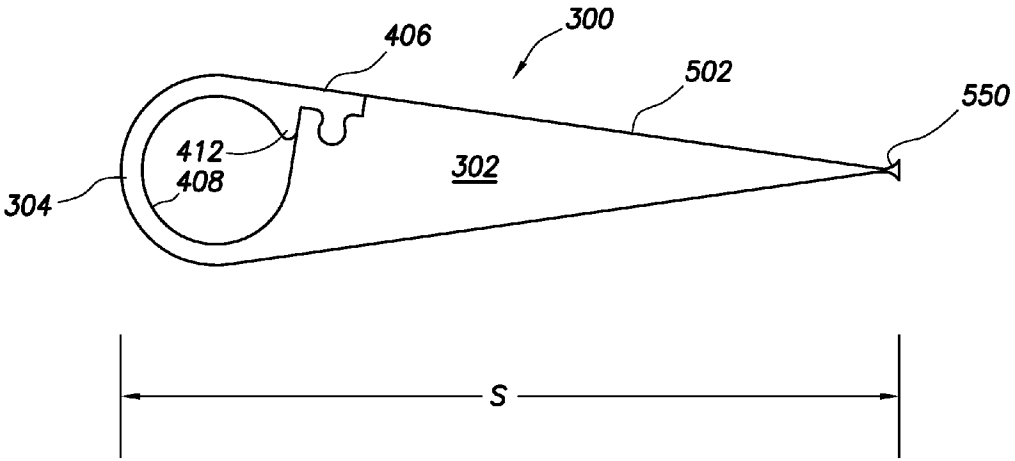
FIG. 5B shows a side elevation view of fairing in a closed configuration, with a bulb-like appendage, and in accordance with at least some embodiments.

In FIG. 5B the flap 304 folded over and coupled to the main body portion 302. In particular, the appendage in the form of bulbous rail 504 is coupled with the groove 510. Once pressed in place, the bulbous rail 504 acts to at least partially hold the distal end 406 of the flap 304. The appendage and groove may in some cases form a major portion of the retention force for the distal end 406 of the flap portion 304, but, as will be discussed more below, in other embodiments the appendage and groove provide a retaining force to ensure an adhesive is given time to set.

Before proceeding, a few additional points will be made in reference to FIGS. 5A and 5B. First, FIGS. 5A and 5B show shoulder member 412. In the FIG. 5B, however, it is illustrated that the shoulder member 412 helps make the inside surface 408 of the flap 304 more circular, which may reduce sticking and help ensure that the fairing 300 may properly weathervane around an attached line. Second, FIG. 5B shows that with the flap portion 304 wrapped around and coupled to the main body portion 302 the fairing 300 defines a short dimension S, which short dimension may be on the order of 18 to 25 cm for a line having a diameter of 38 to 40 mm. Finally, FIGS. 5A and 5B show that, in at least some embodiments, the distal end of the fairing may comprise a flare 550, illustrated as triangular, to help ensure alignment of the fairing 300.

Figure 6A:
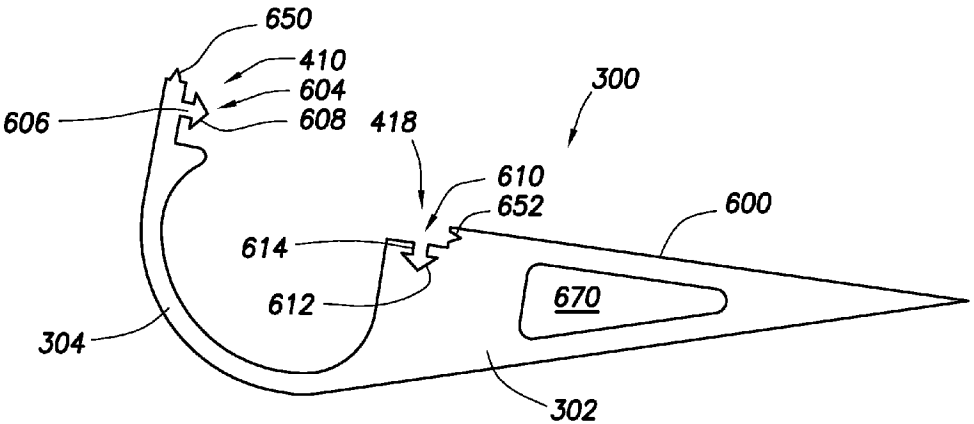
FIG. 6A shows a side elevation view of a fairing both in a partially open configuration, with an arrow-like appendage, and in accordance with at least some embodiments.

FIG. 6A shows a side elevation view of fairing 300 with the flap portion 304 partially open. However, FIG. 6A also shows another alternative appendage 410 and hollow 418 configurations. In particular, the appendage 410 of FIG. 6 takes the form of a rail 604 comprising a proximal portion 606 and a distal portion 608. The proximal portion 606 has a thinner cross-sectional shape, while the distal portion 608 has a thicker cross-sectional shape. In the illustration of FIG. 6A, the thicker cross-sectional shape is triangular.

Likewise, the hollow 418 in these embodiments defines an extended groove having a cross-sectional shape that is a negative image of the rail 604. In particular, groove 612 has a deeper portion 512 that is larger than a shallow portion 614. Moreover, the deeper portion 612 has a cross-sectional shape that matches that of portion 608.

Figure 6B:
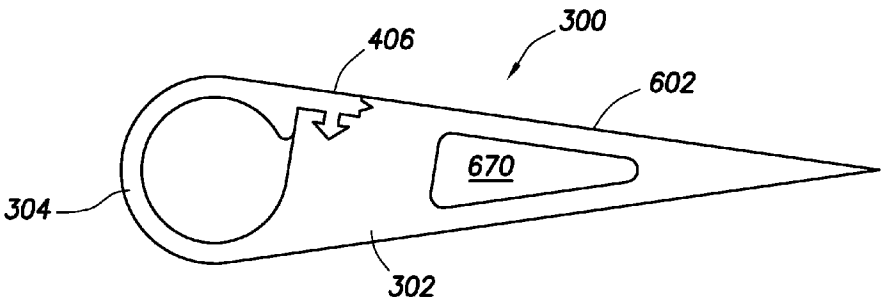
FIG. 6B shows a side elevation view of a fairing both in a partially open configuration, and a closed configuration, with an arrow-like appendage, and in accordance with at least some embodiments.

In FIG. 6B the flap 304 folded over and coupled to the main body portion 302. In particular, the appendage in the form of rail 604 is coupled within the groove 610. Once pressed in place, the rail 604 acts to at least partially hold the distal end 406 of the flap portion 304. The appendage and groove may in some cases form a major portion of the retention force for the distal end 406 of the flap portion 304, but as will be discussed more below, in a particular embodiment the appendage and groove provide a retaining force to ensure an adhesive is given time to set.

FIGS. 6A and 6B show yet still further alternatives regarding the fairing. In particular, in addition to the appendage 410, a flap portion may have a catch portion 650 on a distal face thereof, and likewise the main body 302 may have a corresponding catch portion 652 on a corresponding face of the offset region 416. As illustrated, catch portion 650 may be a protruding tab, which in one case extends along the entire long dimension of the flap 302, but in other cases may extend only partially along the long dimension of the flap. Likewise, the catch portion 652 corresponds to the catch portion 650, and catch portion 652 is shown as a groove. When the flap 302 is coupled to the main body portion 304 as in FIG. 6B, the catch portions 650, 652, working alone or with other features, may help hold the flap portion 302 against the main body portion 304. Though catch portion 650 is shown as triangular, any suitable cross-sectional shape may be used, such rectangular, square, or semi-circular. Moreover, while catch portion 650 is shown as extended tab and catch portion 652 is shown as the corresponding groove, the locations may be reversed. Finally, FIGS. 6A and 6B illustrate that the main body portion 304 need not be a solid structure, and in some cases the main body portion 304 of any of the embodiments may have one or hollows 670, which may reduce the amount of material needed, and may also aid in setting or controlling buoyancy of the cable/fairing combinations once submerged.

The specification now turns to a discussion of coupling a fairing to a lead-in cable in accordance with at least some embodiments. In particular, a new fairing 300 in some cases will be provided from the manufacturer in an "open" configuration—the distal end 406 of the flap portion 304 not coupled to the main body 302. Thus, a first step in coupling the fairing to the lead-in cable may be exposing an adhesive on the fairing. "Exposing" with respect to the adhesive is used in broad sense to cover several possibilities. For example, in a particular embodiment the fairing 300 may arrive from the manufacturing without any adhesive pre-attached. In such situations, the adhesive may be applied in the field (i.e., on the deck of the vessel) just prior to the wrapping the flap portion 304 around the lead-in cable. In other cases, the flap portion 304 may be partially wrapped, and then the adhesive applied. In either case, the adhesive may be applied in any suitable manner, such as applying one or more "beads" or "strips" of the adhesive, the strips extending along the long dimension of the fairing.

In some cases, the adhesive may be applied to the distal end 406 of the flap portion 304, such as on or along the appendage. In addition to, or in place of, applying the adhesive to the appendage, the adhesive may be applied to any surface that will contact the main body portion 302 when the flap portion 304 is wrapped around, such as portions of the inner surface 408 of the flap portion 304, and portions of the shoulder portion 412. In addition to, or in place of, applying the adhesive to the flap portion 304, the adhesive may be applied to the main body portion 302. For example, the adhesive may be applied within the hollow 418, and/or applied to any surface that will contact the flap portion 304 when the flap portion 304 is wrapped around to contact the main body portion 302.

Applying the adhesive may take many forms. For example, in some cases the adhesive may be provided in a tube configured such that an operator may squeeze or roll up the tube to force the adhesive out. In other cases, the adhesive may be provided in a tube configured such that movement of a plunger forces the adhesive out of the tube. The adhesive used will be dictated, at least to some extent, by the material from which the fairing 300 is created, and may be one component or two component adhesives. For illustrative fairings made from polyurethane, an example two component adhesive that may be used is SCOTCH-WELD™ DP 801 two-component adhesive available from 3M of St. Paul, Minn. An illustrative example of a single component adhesive may be SIKAFLEX® 221 available from Sika Corporation of Madison Heights, Mich., although one component adhesives may have longer cure times.

In yet still other embodiments, the adhesive may be pre-applied, such as at the factory or some hours or days before the flap portion 304 is coupled to the main body portion 302. For example, the adhesive may be applied and covered with a protective covering material, such as paper. Before the flap portion 304 is coupled to the main body portion 302, the protective covering material may be removed from the one or more strips of adhesive. Removing the protecting covering material may activate the adhesive, or the adhesive may be pressure sensitive such that the adhesive is activated by applying a compressive force to the adhesive. Thus, exposing the adhesive may include not only applying the adhesive, but also removing protective covering materials over pre-applied adhesives. In other example cases, the adhesive may be a two-part adhesive, where one part is applied on one portion of the fairing (e.g., the flap), and the second part is applied on another portion of the fairing (e.g., the main body). The two parts are then coupled together, with the coupling of the two parts cause the two components of the adhesive to mix and activate.

Regardless of the type of adhesive, a certain amount of cure time may be needed for the adhesive to set, or sufficiently set, before the fairing is deployed into the water. In accordance with at least some embodiments, the appendage 410 on the flap portion 304 and the hollow 418 associated with the main body portion 302 are used to hold the distal end 406 of the flap portion 304 against the main body portion 302 for a sufficient amount of time for the adhesive to at least partially cure. In a particular embodiment, the catch portions 650, 652 may aid in holding the flap portion 304 against the main body portion 302. In some embodiments, once cured the adhesive provides all or substantially the force needed to hold the distal end 406 of the flap portion 304 against the main body portion 302. In other cases, a latching force provided by the appendage 410 and hollow 418, and/or the catch portions 650, 652, may aid in holding the distal end of the flap portion 304 against the main body portion 302.

Figure 7:
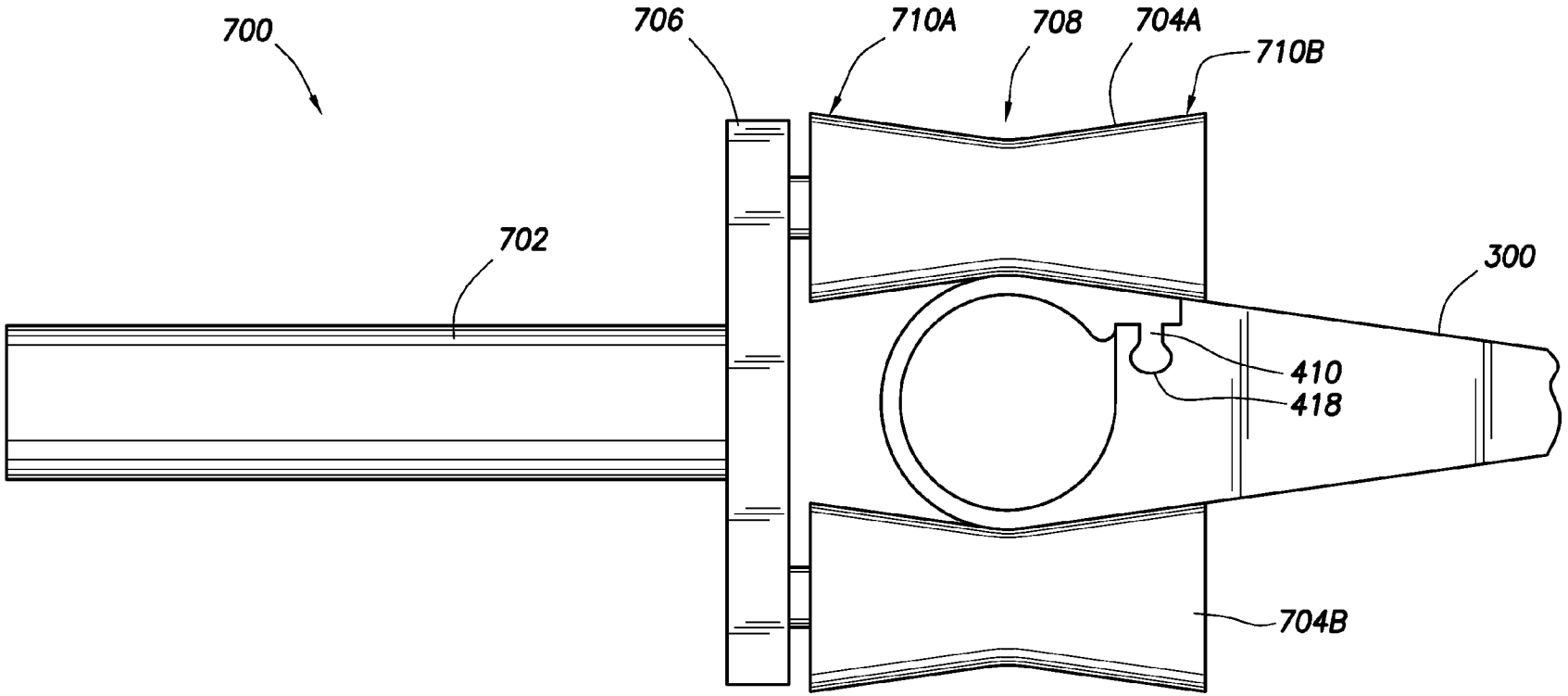
FIG. 7 shows a side elevation view of a tool, along with a cross-sectional view of fairing, in accordance with at least some embodiments.

In accordance with some embodiments, the appendage 410 and corresponding hollow 418 may be designed and constructed such that an operator may couple them together merely by force of hand. In other cases, however, additional tools may be used to help force the appendage 410 (particularly, for example, the rail embodiments) into the corresponding hollow 418. FIG. 7 shows a side elevation view of a tool, along with a cross-sectional view of fairing 300, in accordance with at least some embodiments. In particular, FIG. 7 shows a tool 700, along with a fairing 300 within the tool, to describe one example system and/or method to aid the operator in coupling the flap portion to the body portion of the fairing. The tool 700 comprises handle 702, illustratively shown as a member of circular cross-section, but any shape may be used for the handle 702. In one case, the tool 702 is held in the operator's hands and run along a somewhat stationary fairing 300, and thus the handle 702 may be configured with hand holds. In another case, the tool 702 may be held stationary and the fairing moved through the tool, and thus the handle may be configured to couple to a stand.

The tool further comprises a pair of opposed rollers 704A and 704B. The opposed rollers 704 may be coupled to the handle 702, and held a predetermined distance apart, by way of a brace member 706, such as a rectangular plate. As illustrated, the opposed rollers 704 each define a central portion 708 of reduced diameter surrounded by larger diameter portions 710A and 710B such that the cross-sectional shape of each roller is that of an hourglass. Having each opposed roller 704 in the shape of at least a portion of an hourglass may help hold the fairing in the tool 700 during periods of time of relative movement between them. In other cases, one roller (e.g., the roller opposite the appendage 410 and hollow 418) could be a right circular cylinder, and the other roller having the shape of an hourglass. In yet still other cases, the opposed rollers may both define right circular cylinders.

Thus, in order to install the fairing an operator may expose the adhesive (e.g., applying via an application "gun", or peel the protective layer off a previously applied adhesive), wrap the flap portion around the lead-in cable, and then translate the fairing relative to the tool 700 such that the tool couples the flap portion to the main body portion. After a sufficient amount of time for the adhesive to at least partially cure, the lead-in and attached fairing can then be deployed into the body of water.

The various embodiments may save significant amounts of time over related-art fairings. In particular, in the related-art the flap portions of the fairings are heat welded to the main body portions. That is, each fairing is placed on a table and the lead-in cable wrapped in the flap portion. An operator with a heat gun then works along the interface of the flap portion and the main body portion, melting the two together (i.e., a heat weld). In ideal conditions, the process is very slow (on the order of 30 minutes for each 2.5 meter section). Given that the fairings are normally installed aboard ship at sea, weather conditions may further slow the process, or make the process unworkable. For example, in windy conditions the heat is carried away from the interface of the flap portion and the main body portion, in moist conditions significant heat is required to evaporate water before melting of the fairing portions can begin, and cold weather further slows the process.

With fairings constructed in accordance with the current embodiments, exposing the adhesive, wrapping the flap portion, and coupling the components by running the fairing through the tool 700, the installation process for a 2.5 meter fairing may take 10 minutes or less, and in a particular embodiment with an adhesive that sets in two minutes, the process may take 5 minutes or less, almost independent of weather conditions. Moreover, no heat guns or work surfaces are necessarily needed in the process. For lead-cables that can be 400 to 1200 meters in length, the amount of time to install the fairings disclosed herein will be significantly less than related-art fairings.

Figure 8:
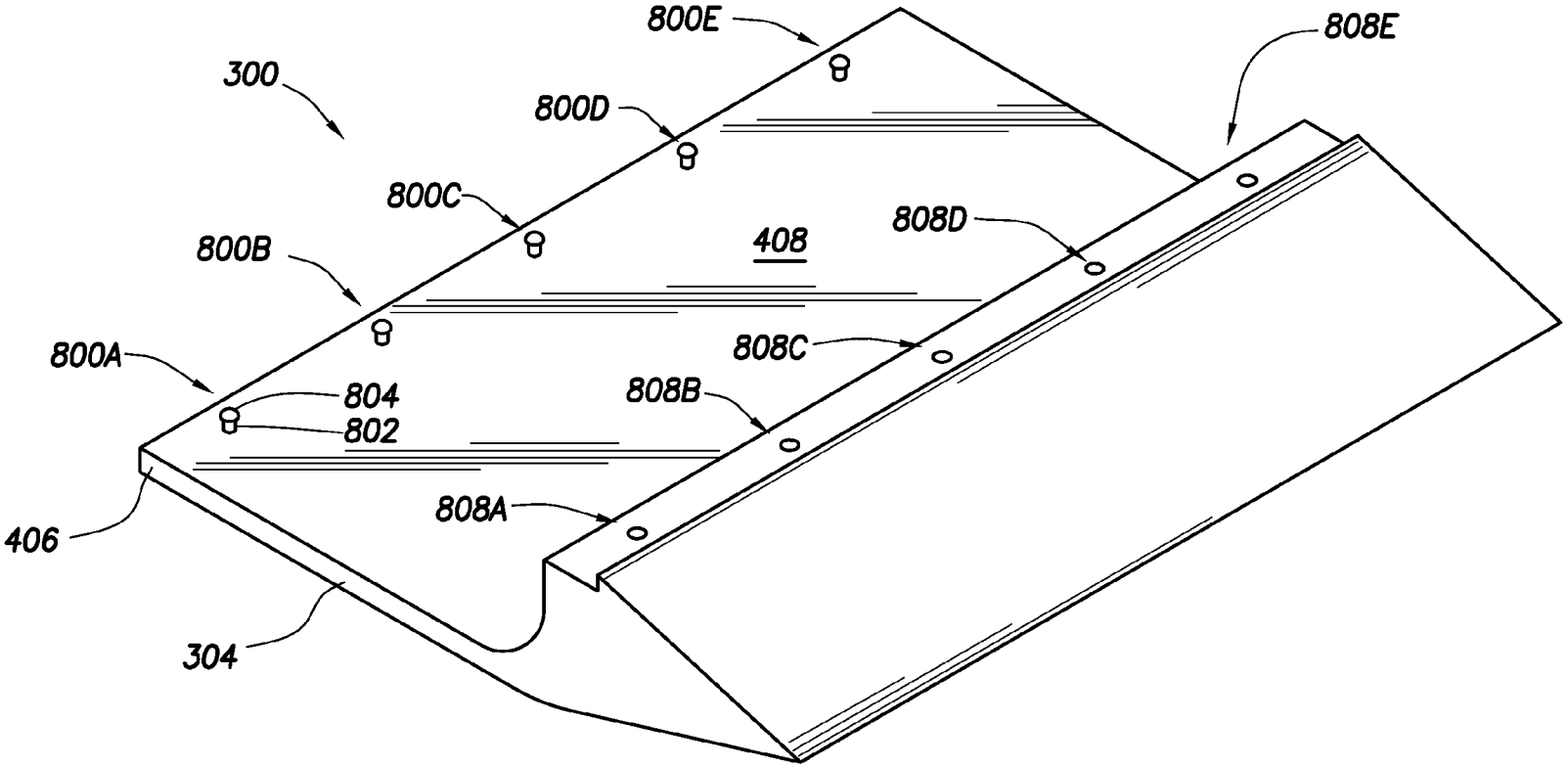
FIG. 8 shows a perspective view of a fairing, in an open configuration, and having individual appendage members, in accordance with at least some embodiments.

The various embodiments to this point have assumed an extended length appendage. That is, a continuous appendage spanning at least one-quarter of the long dimension L of the fairing, and a corresponding hollow. However, the appendage in other embodiments may be a family of individual appendages, and correspondingly a family of hollows on the main body. FIG. 8 shows a perspective view of a fairing 300 in accordance with yet still further embodiments. In particular, fairing 300 has flap portion 304 and main body portion 302, but comprises a series of tabs or appendages 800A though 800E on the inside surface 408. While FIG. 8 shows only five such appendages 800 so as not to unduly complicate the figure, any number may be used. Each illustrated tab-like appendage has a proximal portion 802 of thinner cross-section, and a distal portion 804 of thicker cross-section. Each illustrative appendage 800A through 800E may correspond to a hole or hollow 808A through 808E in the main body portion 302. As before, each hollow 808 may have a cross-sectional shape that is the negative image of its respective appendage 800. As before, the appendages 800 and hollows 808 may be used to hold the distal end 406 of the flap 406 against the main body portion 302 at least while the adhesive sets, and may also provide structural strength during deployed use.

Finally, with respect to FIG. 8, it is noted that not all fairings 300 constructed in accordance with various embodiments need have the shoulder (412 of FIG. 4) on the inner surface 408 of the fairing.

The fairings with a rail-like appendage may be more easily manufactured than fairings with a series of individual appendages. For example, for fairings with a single rail-like appendage extending the entire long dimension L of the fairing (and corresponding groove), the fairings may be extruded in arbitrarily long lengths, and then cut to more management sizes (e.g., 2.5 meter sections). Fairings with a series of individual appendages may need to be cast rather than extruded, which may make the cost per unit more expensive than extruded models.

Figure 9A:
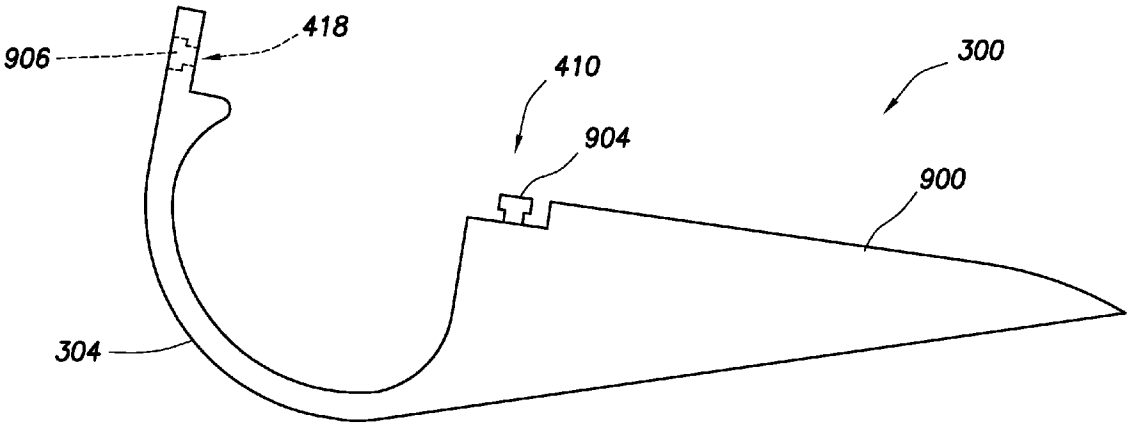
FIG. 9A shows a side elevation view of a fairing in a partially open configuration with appendage(s) on the main body portion, and in accordance with at least some embodiments.
Figure 9B:
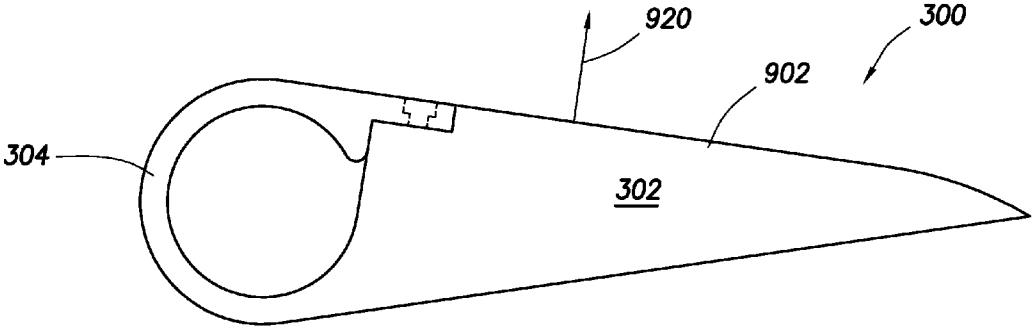
FIG. 9B shows a side elevation view of a fairing both in a closed configuration, with appendage(s) on the main body portion, and in accordance with at least some embodiments.

FIG. 9A shows a side elevation view of fairing 300 with the flap portion 304 partially open. However, FIG. 9A also shows an alternative placement of the appendage 410 and hollow 418. In particular, the appendage 904 in FIG. 9A is part of the main body 302, and the hollow 906 is disposed on the distal end of the flap portion 304. In some cases the appendages 904 are a family of individual appendages, and in other cases the appendages 904 may form rails, but not rails extending the entire length of the fairing. FIG. 9A further shows that the appendages in these embodiments may comprise thinner cross-section proximal ends, and thicker cross-section distal ends. Moreover, while the appendages are shown have a rectangular cross-section, any suitable cross-sectional shape (including those discussed with respect to the previous embodiments) may be used. FIG. 9B shows a side elevation view of fairing 300 with the flap portion 304 folded over and coupled to the main body portion 302.

FIGS. 9A and 9B also show that fairings in accordance with the various embodiments may also define cross-sectional shapes other than a symmetric airfoil. For example, the shape may be a non-symmetrical airfoil shape. It is noted that the non-symmetric airfoil shape is not limited to embodiments with the appendage on the main body—any of the previously discussed embodiments may use a non-symmetric airfoil shape. In particular, fairing 300 of FIGS. 9A and 9B has a longer upper surface than lower surface. Thus, in operation the fairing will create "lift" as illustrated by arrow 920 with relative water movement over the fairing. Such a fairing may be useful in any situation where "lift" is desired, and it is noted that the "lifting" force need not be a force that tends to move the attached line to the surface; rather, the "lift" may be directed downward thus tending to submerge the attached line, or may be directed sideways (e.g., to tension a line).

Figure 10:
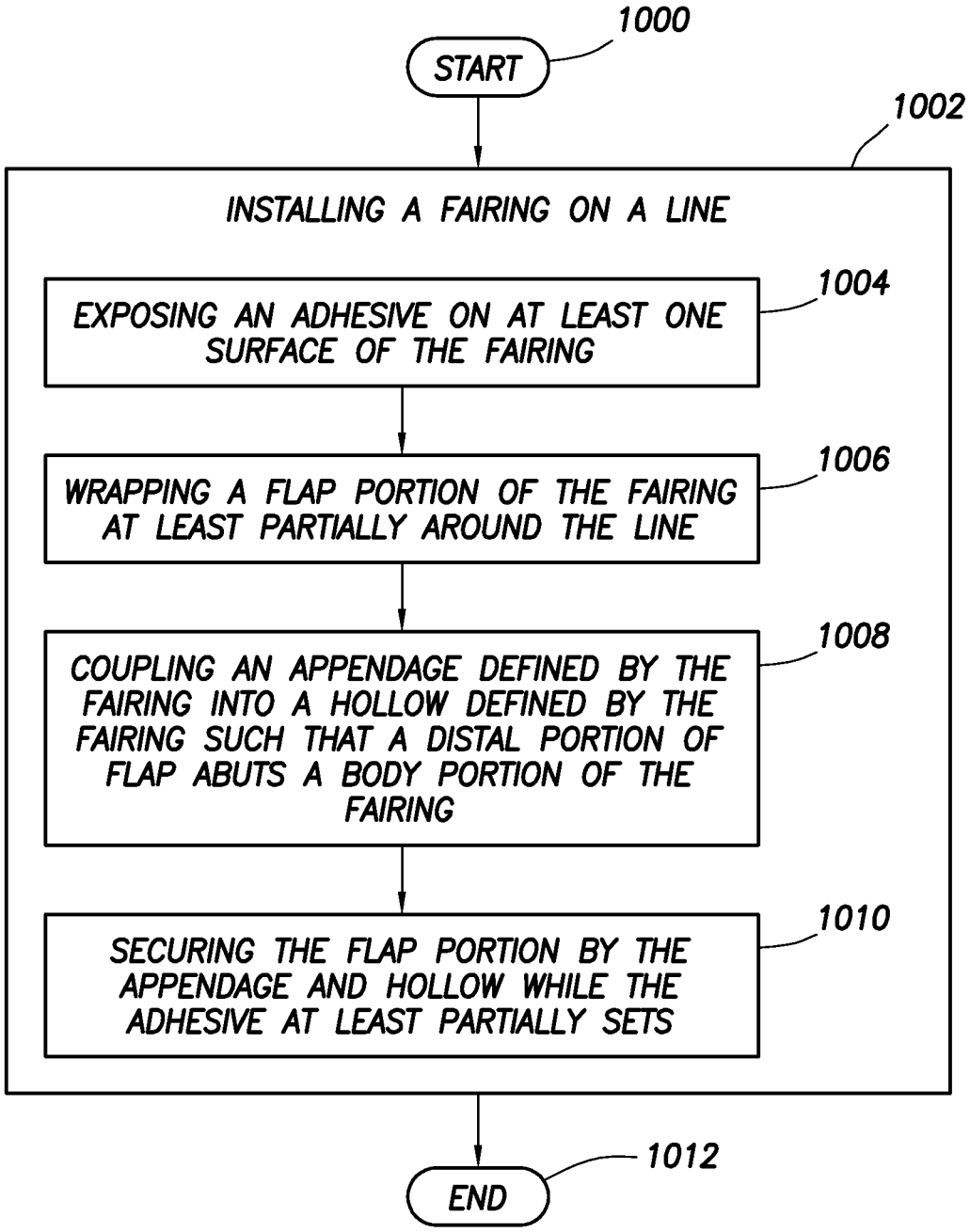
FIG. 10 shows a method in accordance with at least some embodiments.

FIG. 10 shows a method in accordance with at least some embodiments. In particular, the method starts (block 1000) and comprises installing a fairing on a line (block 1002). The installing may comprise: exposing an adhesive on at least one surface of the fairing (block 1004); wrapping a flap portion of the fairing at least partially around the line (block 1006); coupling an appendage defined by the fairing into a hollow defined by the fairing such that a distal portion of flap abuts a body portion of the fairing (block 1008); securing the flap portion by the appendage and hollow while the adhesive at least partially sets (block 1010). Thereafter, the method ends (block 1012), possibly to be restarted on another fairing (e.g., an abutting fairing on the lead-in cable).

References to "one embodiment", "an embodiment", "a particular embodiment", and "some embodiments" indicate that a particular element or characteristic is included in at least one embodiment of the invention. Although the phrases "in one embodiment", "an embodiment", "a particular embodiment", and "some embodiments" may appear in various places, these do not necessarily refer to the same embodiment.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A fairing comprising:

a flap that extends at least partially along a long dimension of the fairing, the flap defines a proximal end and a distal end;

a main body that extends along the long dimension of the fairing, the proximal end of the flap coupled to the main body, and the main body defines a thicker portion proximate the flap and the main body thinner at greater distances from the flap;

an appendage protruding from the fairing, and the appendage defining a cross-sectional shape;

a hollow defined in the fairing, the hollow defining a cross-sectional shape being a negative image of the cross-sectional shape of the appendage, the appendage disposed within the hollow; and a seam defined by the intersection of the distal end of the flap folded back upon and coupled to the main body, the seam extends at least partially along the long dimension of the fairing, the distal end of the flap coupled to the main body by way of the appendage disposed within the hollow, and the seam disposed between a leading edge and a trailing edge of the fairing.

2. The fairing of claim 1 wherein the outer surface of the fairing is configured to define a symmetric airfoil when the flap is coupled to the main body.

3. The fairing of claim 1 wherein the outer surface of the fairing is configured to define a non-symmetric airfoil when the flap is coupled to the main body.

4. The fairing of claim 1 wherein the main body further comprises a flare at a distal end of the main body.

5. The fairing of claim 1 wherein the fairing is configured to weathervane around a line disposed within an inside surface, the inside surface defined when the flap is coupled to the main body.

6. The fairing of claim 1:

wherein the appendage further comprises an elongated protrusion; and wherein the hollow further comprises an elongated groove.

7. The fairing of claim 1:

wherein the appendage further comprises a rail defining a distal portion and a proximal portion, the distal portion defining a thicker cross-sectional shape than a cross-sectional shape of the proximal portion; and wherein the hollow further comprises an elongated groove defining a deep portion and a shallow portion, the deep portion larger than the shallow portion.

8. The fairing of claim 7 wherein the distal portion of the rail at least partially defines a circular cross-section.

9. The fairing of claim 8 wherein the deep portion of the groove at least partially defines a circular cross-section.

10. The fairing of claim 7 wherein the distal portion of the rail at least partially defines a triangular cross-section.

11. The fairing of claim 10 wherein the deep portion of the groove at least partially defines a triangular cross-section.

12. The fairing of claim 1:

wherein the appendage further comprises a tab; and wherein the hollow further comprises a groove.

13. The fairing of claim 1:

wherein the appendage further comprises a tab defining a distal portion and a proximal portion, the distal portion defining a thicker cross-sectional shape than a cross-sectional shape of the proximal portion; and wherein the hollow further comprises a hole defining a deep portion and a shallow portion, the deep portion larger than the shallow portion.

14. The fairing of claim 1 wherein the fairing is a one piece component.

15. The fairing of claim 1 wherein the fairing is extruded thermoplastic.

16. The fairing of claim 1:

wherein the appendage resides on an inner surface of the flap, the appendage proximate to a distal end of the flap; and wherein the hollow is defined on the main body portion.

17. The fairing of claim 1:

wherein the appendage resides on the main body portion; and wherein the hollow is defined on the flap, the hollow proximate to a distal end of the flap.

18. The fairing of claim 1 further comprising an adhesive disposed on at least one location selected from the group consisting of: the distal end of the flap; the main body; the appendage; and the hollow.

19. The fairing of claim 18 wherein the adhesive further comprises a cover material configured to expose the adhesive when the cover material is removed.

20. The fairing of claim 1 further comprising an internal hollow extending within the main body.

21. The fairing of claim 1 further comprising:

a first means for holding the flap against the main body, the first means for holding defined on a distal face of the flap, the first means for holding defines a first cross-sectional shape, and the first means for holding distinct from the appendage and hollow defined in the fairing; and a second means for holding the flap against the main body, the second means for holding defined on the main body, the second means for holding defines a second cross-sectional shape that corresponds to the first cross-sectional shape, and the second means for holding distinct from the appendage and hollow defined in the fairing.

22. The fairing of claim 1 further comprising a tool with opposed rollers configured to couple the appendage to the hollow as the fairing is translated between the opposed rollers.

* * * * *